United States Patent [19]

Caldwell

[11] Patent Number: 4,478,285

[45] Date of Patent: Oct. 23, 1984

[54] METHOD AND APPARATUS FOR REMOVAL OF DOWNHOLE WELL DEBRIS

[75] Inventor: Donald B. Caldwell, Norman, Okla.

[73] Assignee: MAS Mfg. Corp., Norman, Okla.

[21] Appl. No.: 342,369

[22] Filed: Jan. 25, 1982

[51] Int. Cl.[3] ..... E21B 31/08; E21B 37/00

[52] U.S. Cl. ..... 166/311; 166/99; 166/105.1; 166/109

[58] Field of Search ..... 166/105.3, 105.1, 99, 166/107, 109, 311, 165, 162; 175/234, 59

[56] References Cited

U.S. PATENT DOCUMENTS

| | | | |
|---|---|---|---|
| 1,300,346 | 4/1919 | Church | 166/109 X |
| 1,867,833 | 7/1932 | Hill | 175/234 |
| 2,170,568 | 8/1939 | Miller | 166/107 |
| 2,325,503 | 7/1943 | Goble | 166/165 X |
| 4,190,113 | 2/1980 | Harrison | 166/107 X |

*Primary Examiner*—Stephen J. Novosad
*Attorney, Agent, or Firm*—Arnold, White & Durkee

[57] ABSTRACT

A method and apparatus for removing downhole well debris involves an elongate string operable to pump the debris from a well into the string. A pumping portion of the string includes a hollow piston with a hollow, splined piston rod fixed to the upper portion of the string, above the pumping portion, and keyed to the pumping portion to transmit rotary motion from the upper portion to the debris retaining portion below the pumping portion. A hollow piston head includes a valve, advantageously a ball valve, to prevent downward fluid flow. By reciprocating the upper portion, well debris is pumped into the debris retaining portion and solid debris is trapped therein by a one-way check valve. The liquid debris, such as heavy water, continues upwardly through the string passing through the interior of the piston and into the upper portion. The upper portion selectively receives either a ported sub, in which case the liquid is recirculated back into the well or an unported sub that prevents the return of the debris to the well. An additional check valve may be located in the upper portion to retain the liquid in the upper portion and to relieve the stress on the ball valve. The check valves, removably secured within removable subs, preferably are flap valves, including a torsion spring biased flap element with the torsion spring located out of the direct path of fluid movement to decrease valve fouling.

37 Claims, 6 Drawing Figures

METHOD AND APPARATUS FOR REMOVAL OF DOWNHOLE WELL DEBRIS

BACKGROUND OF THE INVENTION

1. Field of the Invention

This invention relates generally to methods and apparatus for removing downhole debris such as sand, liquid such as caustic or heavy water, sludge, fish, balls, plugs and the like.

2. Background Art

For a great many years sand lines have been used to remove sand and other debris from well bores. These sand lines usually involve a piston reciprocated within a cylinder through the action of a surface operated wire line connected to the piston. Conventionally the sand lines include a flapper valve at the lower end to prevent reverse flow from the sand line. This type of device is advantageous in comparison to hydrostatic clean out tools in that a large liquid head is not necessary. While devices of this type have been known for some time, present day oil economics have generated renewed interest in what were once considered spent wells and in methods and apparatus for reactivating these wells.

One device of this general type is disclosed in U.S. Pat. No. 4,190,113 to Harrison. The Harrison structure includes a splined piston rod which allows both reciprocatory and rotary motion to be transferred from the surface to the downhole tool. Solid material is collected within a debris retaining chamber while liquid passes through the piston head along the outside of the piston rod, in contact with the cylinder wall, and outwardly through ports for return to the well bore. A removable, gravity operated, flap valve is located at the inlet to the debris retaining chamber. In addition a check valve is located in the piston head in the form of a resilient flap covering a plurality of apertures which extend through the piston head into the region between the piston rod and the cylinder wall.

However, the inventor of the present invention has determined that, in use, structures of the type disclosed in the Harrison patent are subject to a number of shortcomings. Due to the caustic nature of the liquid located in many plugged oil wells, the piston life is sometimes relatively short. This is because the liquid passes around the piston rod and is retained within the piston chamber, damaging the cylinder and piston walls. Since this action is generally not visible to the user and due to the often long operating periods experienced by these devices, their operating efficiency has suffered. This problem is aggravated by the use of nonmetallic valve elements in connection with the piston head that tend to clog and deteriorate in the extraordinary environment within the well which may include not only caustic liquids but also sand, sludge and debris contaminated liquids.

In addition, the structure exemplified by the Harrison patent provides no means for preventing the return of the liquid to the well bore, important, for example, when the liquid debris is caustic, as well as in the cases where it may be desired to withdraw these liquids from the well. For example, the inventor of the present invention has found that caustic or so called "heavy" water is prevalent in plugged oil wells in some regions of western Texas and that it is desireable to remove this water from the well. However, in many other oil fields, often including nearby wells no such problem exists. In wells with uncontaminated water it may be unnecessary to remove the liquid during cleanout.

The structure disclosed by Harrison is also inefficiently prone to dumping its debris load when a gas pocket is encountered within the well bore. Upon exposure to a high pressure gas pocket the contents of the debris retaining chamber are blown upwardly through the pumping chamber and back outwardly through the ported region within the pumping chamber returning the debris to the well bore. In addition to the loss of the time spent collecting the debris in the first place, passage of the debris through the pump tends to foul the pump, making its operation less efficient or sometimes making the pump inoperable. To alleviate, to a degree, these problems it is known to make the piston head removable from the piston rod in the use of the Harrison structure. However, the threaded connection between the rod and piston head is an uncomplete and unreliable solution to these problems.

SUMMARY OF THE INVENTION

It is a primary object of the present invention to overcome the problems in the prior practice in this field without requiring a large hydrostatic head.

It is an object of the present invention to provide a method and apparatus for removing heavy water from debris clogged wells.

It is also an object of the present invention to provide a pumping apparatus and method for the removal of well debris which permits the separation of solid and liquid components and the selective retention of the liquid components in a region above the pump or, when desired, to allow recirculation of the liquid.

It is another object of the present invention to provide a reciprocating pump cleanout tool which prevents load dumping during a gas blowout.

It is still another object of the present invention to provide a more reliable apparatus for removing well debris, including valves which operate efficiently in the extreme environment experienced downhole.

It is yet another object of the present invention to provide an apparatus and method for removing downhole debris which prevents prolonged contact between the working surfaces of the cylinder and piston with the liquids being pumped upwardly through the device to increase operating efficiency and extend part life.

It is still another object of the present invention to provide a well cleanout device with a reciprocating pump which accomplishes these objects while permitting reciprocatory and rotary motion to be transmitted from the surface to the debris contacting lower end of the tool, enabling drilling, milling, fish retrieval and the like in conjunction with well cleanout operations.

These and many other objects of the present invention are achieved by an apparatus for removing downhole well debris including an elongate string extendable into the well and connectable to a source of reciprocatory and rotary motion. A debris retaining portion of the string includes an inlet in communication with the well and an outlet. The inlet includes a debris retaining check valve. A downhole pump portion of the string is in fluid communication with the outlet of the debris retaining chamber. The pump portion includes a cylinder, a piston, and a splined piston rod, the rod and piston retained for reciprocation within the cylinder. An upper portion of the string is in fluid communication with the pump portion and is connectable to the source of reciprocatory and rotary motion. The piston rod is telescopically received within the cylinder and the upper portion is fixed to the piston rod to communicate the rotary motion of the upper portion to the debris retaining portion through the splined rod. The piston rod and piston head include an internal passageway establishing fluid communication between the upper portion and the debris retaining portion through the pump portion. A check valve is arranged to permit flow through the passageway from the pump portion to the upper portion and to prevent fluid flow in reverse direction.

In accordance with another embodiment of the present invention a method for removing downhole well debris includes the step of forming a string with a debris retaining portion, a pumping portion including a piston and cylinder, and an upper portion. The string is lowered into the well, with the pumping portion located above the debris retaining portion and below the upper portion, until the debris retaining portion is in proximity to the well debris. The upper portion of the string is lifted with respect to the debris retaining portion causing relative movement to occur between the piston and cylinder, pumping the debris into the debris retaining portion. The solid component of the debris is collected within the debris retaining chamber while the liquid component of the debris is passed through the piston in isolation from the cylinder, into the upper portion. The string is turned in the process, to loosen the debris.

DESCRIPTION OF THE PREFERRED EMBODIMENT

Figure 1:
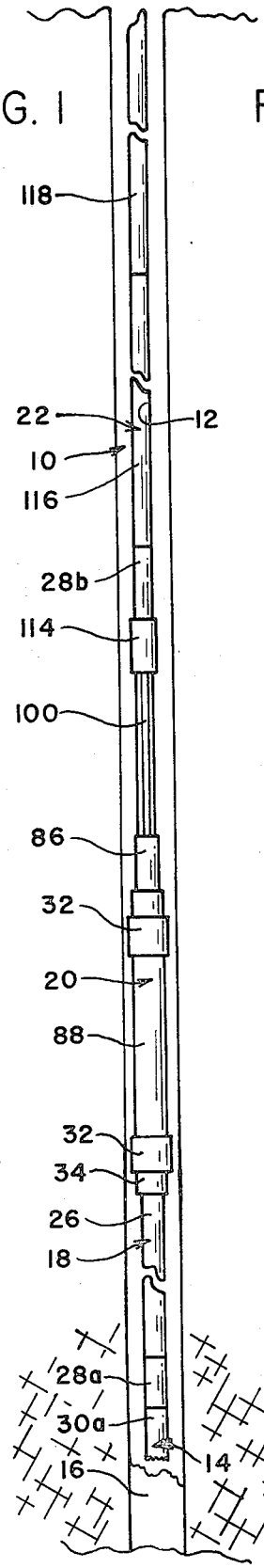
FIG. 1 is a partial, front elevational view of one embodiment of the present invention, shown in position within a cross-sectioned well.

Referring to the drawing wherein like reference characters are used for like parts throughout the several views, a generally tubular string 10, shown in FIG. 1, is positioned within a well 12. The string 10 is connected to a conventional surface workover rig (not shown) for reciprocating the string along the length of the well 12 and for rotating the string within the well around an axis extending parallel to the length of the string 10. The downhole end 14 of the string 10 is located in proximity to well debris 16, for example near a plug or the bottom of the well 12. The string 10 may be either wire line or tubing conveyed; however the use of tubing is preferred to facilitate the rotary motion of the string 10. The string 10 includes a debris retaining chamber 18, a pumping portion 20 and an upper portion 22 connectable to the wire line or tubing, in turn connected to a surface rig (not shown).

Figure 2:
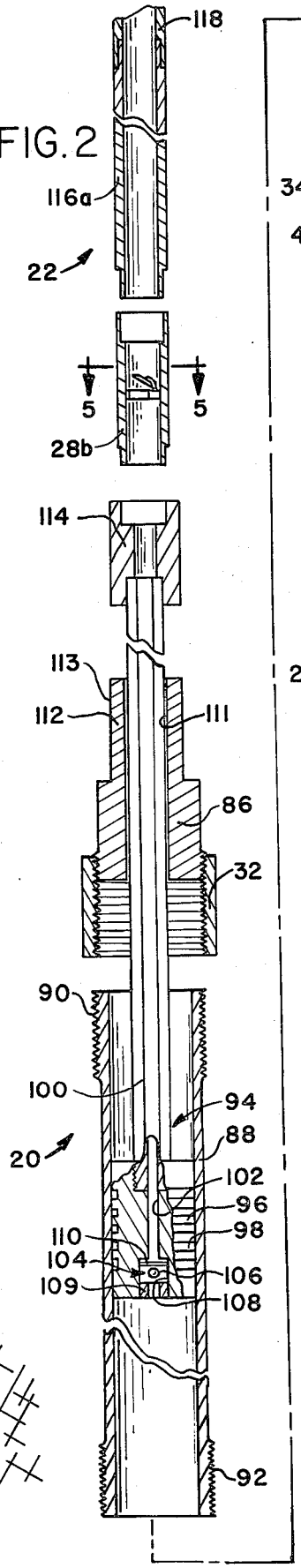
FIG. 2 is an enlarged, exploded view partially cross-sectioned along a central vertical plane through the apparatus shown in FIG. 1.

As shown in FIG. 2, the debris retaining portion 18 includes a feathering sub 24, a solid debris collecting sub 26, a valve sub **28*a*, and a debris engaging sub 30. Each of the subs 24 through 30 is threadedly connected to its adjacent sub to enable selective arrangement, removal, and replacement of the various subs forming the portion 18**.

The feathering sub 24 includes an upper threaded collar 32 and a threaded, apertured plug 34. An elongate bore 36 extends centrally through the plug 34. The diameter of the bore 36 is considerably less than the internal diameter of the adjacent portions of the string 10.

The solid debris collecting sub 26 includes a pair of threaded ends 38 and 40. The threaded end 38 is securable to the threaded end 42 of the plug 34 and the threaded end 40 is releasably securable to the threaded end 44 of the valve sub **28*a*. The interior of the solid debris collecting sub 26 is sized to retain the debris collected from the well 12 and thus may be on the order of as long as 100 feet in length, it normally being desired to remove the entire debris load in a single trip into the well. However, the length of the sub 26 is controlled by the amount of liquid in the well because the pumping portion 20** must be within pumping distance of the fluid column.

Figure 5:
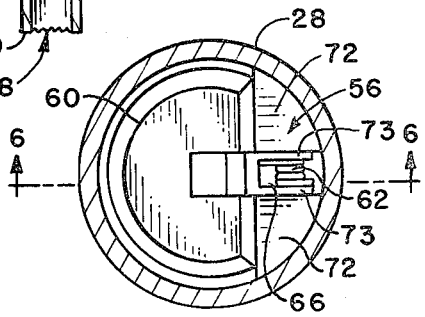
FIG. 5 is an enlarged cross-sectional view taken generally along either of the lines 5—5 in FIG. 2 through the two valve subs, with the valve closed, the view being identical in either case.
Figure 6:
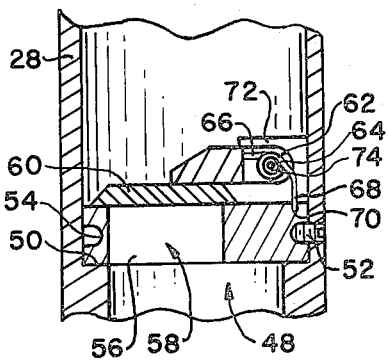
FIG. 6 is a cross-sectional view taken generally along the line 6—6 in FIG. 5.

The valve sub **28*a*, securable to the debris engaging sub 30 by its threaded end 46 and the threaded upper end 47 of the sub 30, includes a one-way valve 48 located within its interior to permit flow upwardly into the string 10 while preventing reverse flow out of the string 10. The valve 48 is preferably an upwardly opening flap valve. One highly advantageous valve for this purpose, shown in FIGS. 5 and 6, is removably located within the interior of the sub 28. The valve 48 is supported atop a ledge 50 formed in the interior surface of the sub 28 and retained against upward movement by a threaded fastener 52, conveniently a conventional set screw, engaging a peripheral annular depression 54 encircling the seat 56 of the valve 48. The seat 56 forms an approximately semi-circular opening 58 closed by a pivotal flap element 60. The flap element 60 is biased to the closed position, engaging the seat 56, by a coiled, torsion spring 62 encircling a pin 64 that mounts the element 60 for pivotal movement with respect to the seat 56. One end 66 of the spring 62 is secured to the flap element 60 while the other end 68 is secured within an aperture 70 in the seat 56**.

Since the spring 62 is situated astride the opening 58 and over the seat 56, it experiences much less exposure to the flow through the sub 28. Further protection against contamination is provided to the spring 62 and pin 64 by the upwardly directed flanges 72 located to either side of the spring 62, connected to the seat 56, and by the lateral tabs 73 of the element 60, that receive the pin 64 and sandwich the spring 62 between themselves. In addition a tubular bushing 74, encircled by the spring 62 as well as by the tabs 73 of the element 60, facilitates the action of the spring 62.

Figure 4:
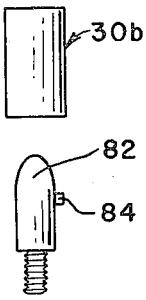
FIG. 4 is an exploded view of a fishing tool useful in connection with the embodiment shown in FIG. 1.

The debris engaging sub 30, connected to the valve sub **28*a* on one end, has, on the other end, an inlet 78 that admits the debris 16 into the string 10. A variety of conventional debris engaging subs may be used as the sub 30, depending on the intended use of the string 10. The drilling sub 30*a*, shown in FIG. 2, for example, includes a serrated lower edge 80 useful in grinding or drilling solid debris 16 to enable the particles to be sucked inwardly into the string 10. The retrieving sub 30*b* shown in FIG. 4, is useful for engaging and removing a lodged downhole fish 82 using a conventional engaging means (not shown) located in its interior. Upon downward movement and subsequent rotation of the string 10, the sub 30***b* engages and is locked onto the outwardly extending pin 84 of the fish 82. Any conventional debris engaging sub may be used in place of the illustrated subs 30*a* and 30*b* for drilling, milling, retrieving fish, collecting junk, supplying liquid, cleaning, swabbing, bailing or the like, all well known in the art.

Located atop the debris retaining portion 18, the pumping portion 20 includes a drive sub 86 and a collar 32 threadedly connecting the sub 86 to a cylinder 88. The cylinder 88 includes a threaded end 90 engaging oen collar 32 and a threaded end 92 threading onto the collar other 32. A piston 94 is mounted for reciprocation within the sub 86 and the cylinder 88. Specifically the piston head 96, mounted for reciprocation in close conformity to the inside walls of the cylinder 88, includes a plurality of encircling seals 98, conveniently in the form of piston rings providing an occlusive seal between the piston head 96 and the cylinder wall 88. The piston rod 100, conveniently threaded into the head 96, is in the form of a splined shaft, preferrably a hollow hexagonal kelly bar. An interior passage 102 is formed through the piston rod and the piston head 96, providing liquid communication through the pumping portion 20. Within the passage 102, conveniently located within the piston head 96, a ball valve 104 conveniently includes a steel ball 106 contained within an enlarged or bored out chamber 108 and a transverse pin 110 located between the ball 106 and the upper end of the chamber 108. The chamber 108 is closed by a replaceable annular seat 109, that conveniently threads into the lower end of the chamber 108.

The piston rod 100 telescopes through the drive sub 86 and a broached interior surface 111 of the portion 112 of the drive sub 86 conforms to the splined exterior configuration of the piston rod 100 to key the rod 100 to the pumping portion 20. The exterior surface 113 of the portion 112 also provides a reduced diameter fishing neck to enable a fishing tool to catch or slide over and catch the portion 112. The upper end of the piston rod 100 is secured to a coupler 114, conveniently by a threaded connector, the coupler 114 in turn threadedly secured to a valve sub 28*b*, identical to the valve sub 28*a* secured to the bottom of the solid debris collecting sub 26. The valve sub 28*b* double checks the debris and thereby relieves the stress on the ball valve 104. Reciprocation of the piston 94 pumps fluid from the well 12 upwardly through the debris retaining portion 18 and upwardly through the pumping portion 20. A very slight clearance between the piston head 96 and the cylinder 88 insures the generation of high pumping pressure while allowing a very small quantity of liquid to lubricate the passage of the head 96 with respect to the cylinder 88. Excess liquid is ported through the joint between the rod 100 and sub 86.

Figure 3:
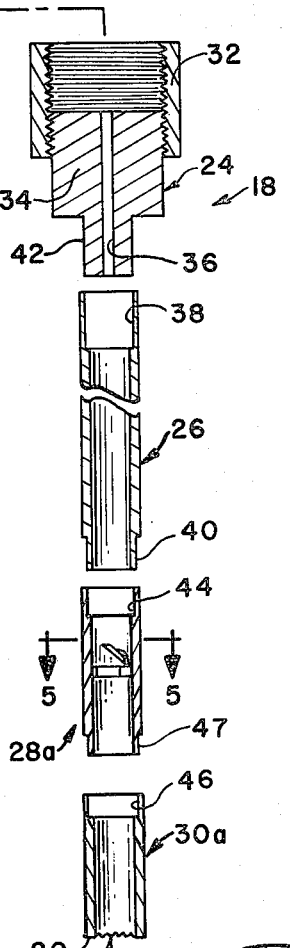
FIG. 3 is a front elevational view of a ported sub useful in the embodiment shown in FIG. 1.
Figure 3:
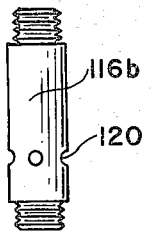

The upper portion 22 includes a liquid receiving sub 116 threadedly connected to the adjacent valve sub 28*b* and to the remaining portion of the string 10, illustrated in the form of tubing 118. As shown in FIG. 2, the liquid receiving sub 116 may take the form of a closed cylinder 116*a*, that receives any liquid passing through the pumping portion 20 and retains that liquid above the valve sub 28*b*. As desired, the liquid receiving sub 116*a* may be replaced with a ported liquid receiving sub 116*b*, shown in FIG. 3, including a plurality of openings 120 venting liquid received within the sub 116*b* outwardly to the well 12.

In accordance with the preferred method of operation, the string 10 is utilized as follows. The string 10 is initially lowered into the well 12 until the downhole end 14 contacts the debris 16 to be removed. The device 10 may be utilized to remove any downhole debris including, for example, sand, liquid, heavy water, fish, balls, plugs, junk or the like. Upon contact between the string 10 and the debris 16, the string 10 is reciprocated using conventional surface apparatus (not shown). This reciprocation is transmitted from the upper portion 22 to the piston rod 100 through the coupler 114. As the result the piston rod 100 telescopes through the drive sub 86 while the piston head 96 reciprocates along the inside surface of the cylinder 88. The vertical reciprocation is not, therefore, normally transmitted to the cylinder 88 and the remainder of the string 10 below the cylinder 88.

Thus, in response to the upward movement of the piston head 96, suction is created in the cylinder 88, and debris 16 is drawn inwardly through the inlet 78 into the debris retaining portion 18. The passage of the debris 16 into the debris collecting sub 26 is made possible by the opening of the one-way valve 48 in the sub 28*a*, the valve swinging upwardly, as indicated in FIG. 2, to admit the solid and liquid debris. At the same time the valve 104 is closed. Due to the length of the solid debris collecting sub 26, the solid debris separates from the liquid debris and begins to settle out while the liquid debris continues upwardly through the feathering sub 24. As the liquid encounters the lower end of the feathering plug 34 and begins to pass through the elongate bore 36, an upwardly directed force is applied to the string 10. This normally prevents the string 10 from sucking itself into the debris 16 and becoming lodged therein. The liquid then continues upwardly into the pumping portion 20 filling the cylinder 88.

After being lifted upwardly by the surface apparatus, the upper portion 22 of the string 10 and the piston 94 move downwardly, under influence of gravity and particularly due to the weight of the piston rod 100. As the piston 94 moves downwardly, the valve 104 is opened and the pressure produced by the piston 94 closes the valve 48 in the valve sub 28*a*. This prevents the solid debris 16 from escaping from the string 10. The transverse pin 110 prevents the ball 106 from sealing against the upper edge of the chamber 108, preventing the closing of the valve 104 and allowing the liquid to proceed upwardly through the piston rod 100 into the liquid receiving sub 116 on the piston 94 downstroke. This opens the valve 48 in the sub 28*b* located beneath the liquid receiving sub 116. Upon the cessation of pumping the liquid is trapped in the sub 116 by the action of the one-way valve 48 in the valve sub 28*b*.

If it is desired to remove the liquid debris from the well 12, the unported sub 116*a* is secured to the valve sub 28*b*. The liquid can then either be pumped to the surface or it can be lifted to the surface with the string 10 upon completion of the job. When the contaminated liquid is collected for removal, it may sometimes be necessary to add water from the surface to create a sufficient head to permit pumping. If in subsequent operations it is not desired to remove the liquid from the well, the sub 116*a* may be replaced by the ported sub 116*b*. The sub 116*b* recirculates the liquid, separated from the solid debris, back to the well.

During the pumping action provided by the pumping portion 20 in response to the reciprocation of the string 10, the string 10 can also be turned or rotated around its elongate axis. This rotary motion is transmitted through the piston rod 100 to the debris engaging sub 30 by the keyed engagement of the drive sub 86, particularly the portion 112, with the periphery of the splined piston rod 100. In the case of the sub 30*a* with the serrated lower edge 80 this results in the grinding of the debris 16 making it possible to subsequently suck the debris inwardly into the string 10. However, in the case of the fish collecting sub 30*b* the rotary motion can be used to latch onto a fish, such as the fish 82 shown in FIG. 4.

The one-way valves 48 quickly snap closed to prevent reverse or downward debris flow, due to the action of torsion springs 62. The location of the torsion springs 62 prevents their fouling, since they are not located directly in the fluid path and are protected against dirt and grime accrual by the bushing 74 and the arrangement of the tabs 73 and flanges 72 surrounding the spring 62. In the unlikely event that the valve 48 becomes fouled, it can be simply removed from the valve sub 28 for repair or replacement by loosening the fastener 52.

If a gas pocket is encountered during well cleanout operations, the contents of both the liquid receiving sub 116 and solid debris collecting sub 26 are preserved through the use of the unported sub 116*a*. The high pressure gas may blow the solid debris contained in the debris retaining portion 18 upwardly through the pumping portion 20 to collect within the liquid receiving sub 116*a*. This is highly advantageous in preventing the return to the borehole of the debris that has been collected often after a great deal of effort. The passage of the debris through the pumping portion 20 is by way of the internal passage 102 ensuring that the reciprocation of the piston 94 is not affected by any debris accumulation thereby preventing piston damage. In addition, the anti-fouling ball valve 104 is not prone to sticking regardless the nature of the debris passing through it. Due to the incorporation of the passage 102 the debris contained within the liquid receiving sub 116, does not oppose or interfere with the motion of the piston 94, since the debris is contained in a separate chamber formed in the sub 116*a*, thereby increasing the life of the piston 94 and diminishing its working load, under such circumstances.

The piston 94 can also create either a manual or hydraulic jar. The manual or mechanical jar is produced by impacting the upper end of the piston head 96 against the drive sub 86. A hydraulic jar is produced by a pulling the piston head 96 against the drive sub 86, resiliently stretching the string 10, and suddenly releasing this tension, producing a fluid surge. Either jarring technique is useful in freeing the string 10 when it becomes stuck in the debris.

It should be understood that numerous modifications of the invention described herein can be devised by those skilled in the art which fall within the spirit and scope of the principles of this invention, even if the invention is not practiced as specifically described herein.

What is claimed and desired to be secured by Letters Patent of the United States is:

1. An apparatus for removing downhole well debris, comprising:

an elongate string extendable into a well, said string connectable to a source of reciprocatory and rotary motion;

a debris retaining portion, located in said string, including an outlet and an inlet capable of selective communiation with said well, said inlet including a debris retaining check valve;

a downhole pump portion located in said string in fluid communication with the outlet of said debris retaining portion, said pump portion including a cylinder, a piston and a piston rod, said piston retained for reciprocation within said cylinder and keyed to said cylinder;

an upper portion of said string in fluid communication with said pump portion and connectable to said source of reciprocatory and rotary motion on one end and to said piston rod on the other end, said piston keyed to said cylinder to communicate the rotary motion of said under portion to said debris retaining portion;

said piston rod and piston head including an internal passageway establishing fluid communication between said upper portion and said debris retaining portion through said pump portion;

a check valve located at the end of said passageway atop said pump portion; and a check valve arranged to permit flow through said passageway from said pump portion to said upper portion and to prevent flow in the reverse direction.

2. The apparatus of claim 1 wherein said piston rod is a hollow kelly bar, said cylinder including an upper end conforming to the splined exterior configuration of said kelly bar.

3. The apparatus of claim 1 wherein at least one of said check valves is a flap valve, said flap valve including a valve seat, a spring and a flap element, said flap element being biased by said spring into a position engaging said seat.

4. The apparatus of claim 3 wherein said flap valve is arranged within a tubular sub, said flap valve having a fluid passageway of smaller size than the size of the internal passageway within said sub, said spring being a coil spring arranged over said seat out of the path of direct fluid movement through said sub.

5. The apparatus of claim 4 wherein said flap valve is removably locatable within said sub.

6. The apparatus of claim 1 wherein said piston includes an internal valve located in said passageway.

7. The apparatus of claim 6 wherein said internal valve is a ball valve.

8. The apparatus of claim 6 wherein said internal valve includes means for preventing the valve from seating closed during downward piston movement.

9. The apparatus of claim 6 including a seat removably threaded into said piston.

10. The apparatus of claim 1 including a fluid collecting chamber located atop said pumping chamber in fluid communication with said passageway.

11. The apparatus of claim 10 wherein said fluid collecting chamber is connected to the upper end of said piston rod.

12. The apparatus of claim 11 wherein said fluid collecting chamber is removable from said string.

13. The apparatus of claim 1 including a ported sub removably located atop said piston rod in fluid communication with said passageway through said piston.

14. The apparatus of claim 1 including a feathering sub, said sub including a reduced diameter passageway for supplying an upward force to said string in response to the passage of liquid through said sub.

15. The apparatus of claim 1 including a drilling tool connected to the lowermost end of said debris retaining portion.

16. The apparatus of claim 1 including a fishing tool attached to the lowermost end of the debris retaining portion.

17. The apparatus of claim 1 including a drive sub connectable to the upper end of said cylinder, said drive sub including a fishing neck on its exterior surface and a broached interior surface conforming to the splined exterior surface of said piston rod.

18. The apparatus of claim 1 including jarring means for jarring said string free of entanglement.

19. A method for removing downhole well debris comprising the steps of:

forming a string including a debris retaining portion, a pumping portion including a piston and cylinder, and an upper portion;

lowering the string into the well with the pumping portion located above the debris retaining portion and below the upper portion, until the debris retaining portion is in proximity to the well debris;

lifting the upper portion of said string with respect to a debris retaining portion, causing relative motion to occur between said piston and cylinder, to pump the debris into the debris retaining portion;

collecting the solid component of the debris within said debris retaining portion;

passing the liquid component of the debris through the piston head and piston rod of said piston, in isolation from the cylinder, and into the upper portion;

turning the string to loosen the debris;

securing a hollow chamber along said string fixed to the piston rod of said piston; and subsequently replacing said hollow chamber with a chamber ported to the exterior of said string to retain said liquid in the well.

20. The method of claim 19 including the step of hydraulically jarring said string.

21. The method of claim 19 including the step of manually jarring said string.

22. The method of claim 19 including the step of pumping liquid from said chamber to the surface.

23. The method of claim 19 including the step of holding said liquid within said chamber and subsequently lifting said string and said liquid from the well.

24. A method for removing solid and liquid downhole well debris including caustic liquid or heavy water comprising the steps of:

lowering a string into a well until the inlet end of such string is in proximity to said debris;

reciprocating a portion of said string to pump said debris into said string;

separating the solid debris from the liquid debris;

collecting said solid debris in a lower chamber;

passing said liquid debris through the interior of a reciprocating piston having a piston head and rod;

collecting said liquid in a chamber connected to the upper end of said piston rod;

removing said debris from said well; and withdrawing said string from the well and replacing said chamber with a ported sub.

25. The method of claim 24 including the step of pumping said liquid to the surface.

26. The method of claim 24 including the step of lifting said liquid to the surface with said string.

27. The method of claim 24 including the step of rotating said string to drill and loosen said debris.

28. The method of claim 24 including the step of adding water to the well to generate a sufficient hydraulic head to enable fluid pumping.

29. The method of claim 24 including the step of pumping said liquid through an internal passage extending through a piston rod and piston head of said piston.

30. An apparatus for removing downhole well debris, comprising:

an elongate string extendable into a well, said string connectable to a source of reciprocatory and rotary motion;

a debris retaining portion, located in said string, including an outlet and an inlet capable of selective communication with said well, said inlet including a debris retaining check valve;

a downhole pump portion located in said string in fluid communication with the outlet of said debris retaining portion, said pump portion including a cylinder, a piston and a piston rod, said piston retained for reciprocation within said cylinder and keyed to said cylinder;

an upper portion of said string in fluid communication with said pump portion and connectable to said source of reciprocatory and rotary motion on one end and to said piston rod on the other end, said piston keyed to said cylinder to communicate the rotary motion of said upper portion to said debris retaining portion;

said piston rod and piston head including an internal passageway establishing fluid communication between said upper portion and said debris retaining portion through said pump portion;

a check valve arranged to permit flow through said passageway from said pump portion to said upper portion and to prevent fluid flow in the reverse direction; and at least one of said check valves being a flap valve, said flap valve including a valve seat, a spring and a flap element, said flap element biased by said spring into a position engaging said seat, said flap valve being arranged within a tubular sub, said flap valve having a fluid passageway of smaller size than the size of the internal passageway within said sub, said spring being a coil spring arranged over said seat and out of the path of direct fluid movement through said sub.

31. The apparatus of claim 30 wherein said flap valve is removably locatable within said sub.

32. An apparatus for removing downhole well debris, comprising:

an elongate string extendable into a well, said string connectable to a source of reciprocatory and rotary motion;

a debris retaining portion, located in said string, including an outlet and an inlet capable of selective communication with said well, said inlet including a debris retaining check valve;

a downhole pump portion located in said string in fluid communication with the outlet of said debris retaining portion, said pump portion including a cylinder, a piston and a piston rod, said piston retained for reciprocation within said cylinder and keyed to said cylinder;

an upper portion of said string in fluid communication with said pump portion and connectable to said source of reciprocatory and rotary motion on one end and to said piston rod on the other end, said piston keyed to said cylinder to communicate the rotary motion of said upper portion to said debris retaining portion;

said piston rod and piston head including an internal passageway establishing fluid communication between said upper portion and said debris retaining portion through said pump portion; and a check valve arranged within said piston and located in said passageway, to permit flow through said passageway from said pump portion to said upper portion and to prevent fluid flow in the reverse direction, said check valve including a seat removably threaded into said piston.

33. An apparatus for removing downhole well debris comprising:

an elongate string extendable into a well, said string connectable to a source of reciprocatory and rotary motion;

a debris retaining portion, located in said string, including an outlet and an inlet capable of selective communication with said well, said inlet including a debris retaining check valve;

a downhole pump portion located in said string in fluid communication with the outlet of said debris retaining portion, said pump portion including a cylinder, a piston and a piston rod, said piston retained for reciprocation within said cylinder and keyed to said cylinder;

an upper portion of said string in fluid communication with said pump portion and connectable to said source of reciprocatory and rotary motion on one end and to said piston rod on the other end, said piston keyed to said cylinder to communicate the rotary motion of said upper portion to said debris retaining portion;

said piston rod and piston head including an internal passageway establishing fluid communication between said upper portion and said debris retaining portion through said pump portion;

a check valve arranged to permit flow through said passageway from said pump portion to said upper portion and to prevent fluid flow in the reverse direction; and a ported sub removably located atop said piston rod in fluid communication with said passageway through said piston.

34. An apparatus for removing downhole well debris comprising:

an elongate string extendable into a well, said string connectable to a source of reciprocatory and rotary motion;

a debris retaining portion, located in said string, including an outlet and an inlet capable of selective communication with said well, said inlet including a debris retaining check valve;

a downhole pump portion located in said string in fluid communication with the outlet of said debris retaining portion, said pump portion including a cylinder, a piston and a piston rod, said piston retained for reciprocation within said cylinder and keyed to said cylinder;

an upper portion of said string in fluid communication with said pump portion and connectable to said source of reciprocatory and rotary motion on one end and to said piston rod on the other end, said piston keyed to said cylinder to communicate the rotary motion of said upper portion to said debris retaining portion;

said piston rod and piston head including an internal passageway establishing fluid communication between said upper portion and said debris retaining portion through said pump portion;

a check valve arranged to permit flow through said passageway from said pump portion to said upper portion and to prevent fluid flow in the reverse direction; and a feathering sub, said sub including a reduced diameter passageway for supplying an upward force to said string in response to the passage of liquid through said sub.

35. An apparatus for removing downhole well debris comprising:

an elongate string extendable into a well, said string connectable to a source of reciprocatory and rotary motion;

a debris retaining portion, located in said string, including an outlet and an inlet capable of selective communication with said well, said inlet including a debris retaining check valve;

a downhole pump portion located in said string in fluid communication with the outlet of said debris retaining portion, said pump portion including a cylinder, a piston and a piston rod, said piston retained for reciprocation within said cylinder and keyed to said cylinder;

an upper portion of said string in fluid communication with said pump portion and connectable to said source of reciprocatory and rotary motion on one end and to said piston rod on the other end, said piston keyed to said cylinder to communicate the rotary motion of said upper portion to said debris retaining portion;

said piston rod and piston head including an internal passageway establishing fluid communication between said upper portion and said debris retaining portion through said pump portion;

a check valve arranged to permit flow through said passageway from said pump portion to said upper portion and to prevent fluid flow in the reverse direction; and a fishing tool attached to the lower most end of the debris retaining portion.

36. An apparatus for removing downhole well debris comprising:

an elongate string extendable into a well, said string connectable to a source of reciprocatory and rotary motion;

a debris retaining portion, located in said string, including an outlet and an inlet capable of selective communication with said well, said inlet including a debris retaining check valve;

a downhole pump portion located in said string in fluid communication with the outlet of said debris retaining portion, said pump portion including a cylinder, a piston and a piston rod, said piston retained for reciprocation within said cylinder and keyed to said cylinder;

an upper portion of said string in fluid communication with said pump portion and connectable to said source of reciprocatory and rotary motion on one end and to said piston rod on the other end, said piston keyed to said cylinder to communicate the rotary motion of said upper portion to said debris retaining portion;

said piston rod and piston head including an internal passageway establishing fluid communication between said upper portion and said debris retaining portion through said pump portion;

a check valve arranged to permit flow through said passageway from said pump portion to said upper portion and to prevent fluid flow in the reverse direction; and a drive sub connectable to the upper end of said cylinder, said piston rod having a splined exterior surface, said drive sub including a fishing neck on its exterior surface and a broached interior surface conforming to the splined exterior surface of said piston rod.

37. A method for removing downhole well debris comprising the steps of:

forming a string including a debris retaining portion, a pumping portion including a piston and cylinder and an upper portion;

lowering the string into the well with the pumping portion located above the debris retaining portion and below the upper portion, until the debris retaining portion is in proximity to the well debris;

lifting the upper portion of said string with respect to a debris retaining portion, causing relative motion to occur between said piston and cylinder, to pump the debris into the debris retaining portion;

collecting the solid component of the debris within said debris retaining portion;

passing a liquid component of a debris through the piston head and piston rod of said piston, in isolation from the cylinder, and into the upper chamber;

turning the string to loosen the debris; and checking the reverse flow of the liquid from the string at two successive locations above the debris retaining portion.

* * * * *